United States Patent [19]

Abler et al.

[11] 3,999,405

[45] Dec. 28, 1976

[54] AIR CONTROL SYSTEM FOR PILE KNITTING MACHINE

[75] Inventors: Norman C. Abler, Menominee Falls; Ralph A. Koegel, Brookfield, both of Wis.

[73] Assignee: Bunker Ramo Corporation, Oak Brook, Ill.

[22] Filed: Aug. 11, 1975

[21] Appl. No.: 603,639

[52] U.S. Cl. ..... 66/9 B; 66/166; 66/147

[51] Int. Cl.[2] ..... D04B 9/14

[58] Field of Search ..... 66/152, 153, 166, 9 B, 66/147, 149 R, 149 S

[56] References Cited

UNITED STATES PATENTS

| | | | |
|---|---|---|---|
| 1,784,446 | 12/1930 | Jennings | 66/166 |
| 2,723,546 | 11/1955 | Buckreus | 66/147 |
| 2,844,952 | 7/1958 | Wawzonek | 66/147 |
| 2,953,912 | 9/1960 | Hill | 66/9 B |
| 3,003,342 | 10/1961 | Kent et al. | 66/153 |
| 3,014,355 | 12/1961 | Hill | 66/9 B |
| 3,280,594 | 10/1966 | Frishman | 66/9 B |
| 3,728,872 | 4/1973 | Thore | 66/9 B |
| 3,926,015 | 12/1975 | Sangiacomo | 66/149 S X |

*Primary Examiner*—Mervin Stein
*Assistant Examiner*—Andrew M. Falk
*Attorney, Agent, or Firm*—Frederick M. Arbuckle; William Lohff

[57] ABSTRACT

Rotating baffle supported from below substantially closes opening at knitting level of tubular fabric produced by circular pile fabric knitting machine, and deflects air jet carrying stray fiber up toward exhaust intake above machine. Secondary rotating baffle at lower level further reduces movement of air with entrained fiber into tubular fabric, and carries stop motion ring. Rotation of the ring with the goods minimizes skewing at the tube slitting point.

18 Claims, 1 Drawing Figure

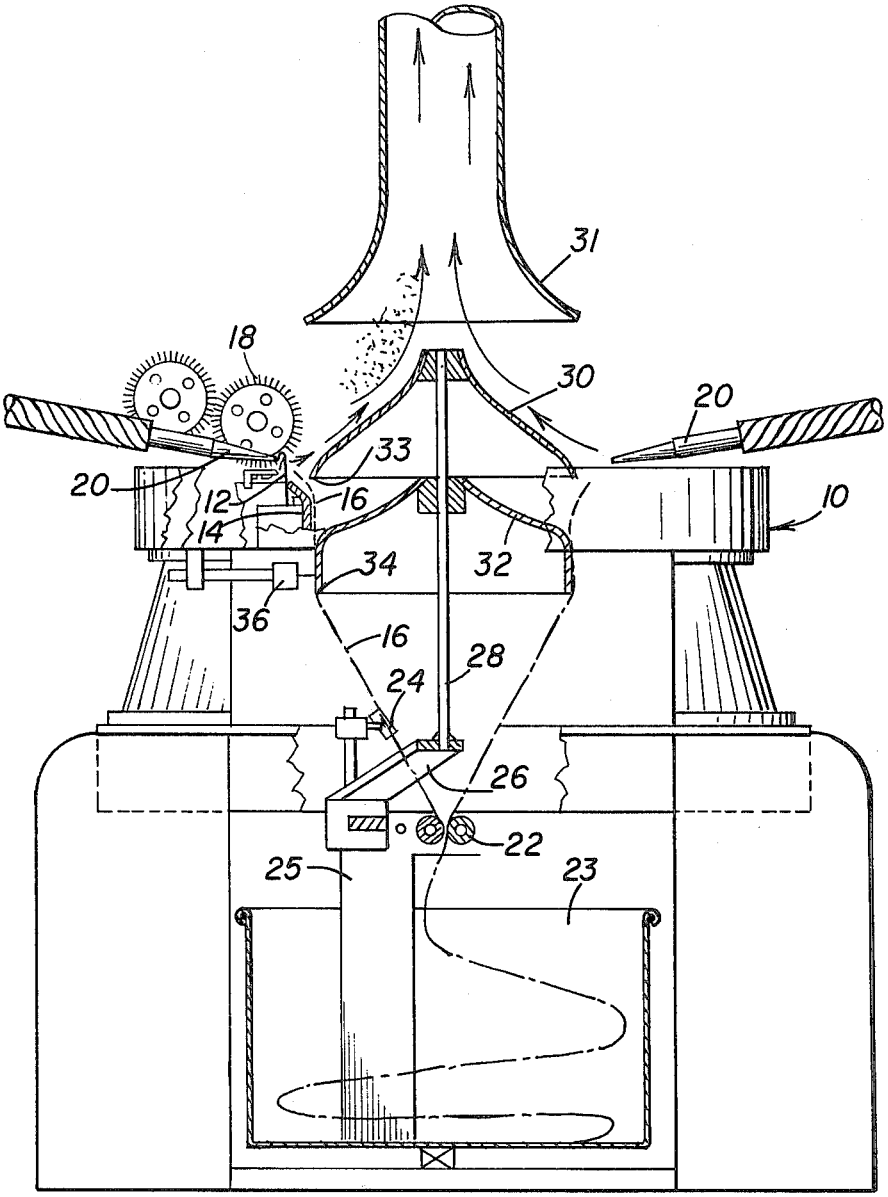
31
18
30
20
33
20
12
16
10
14
34
32
36
16
28
24
26
22
25
23

AIR CONTROL SYSTEM FOR PILE KNITTING MACHINE

BACKGROUND

This invention relates to the provision of rotating baffle means for air movement control in a circular deep pile fabric knitting machine. It has particular usefulness when applied to circular knitting machines of the type having a rotating needle cylinder. Such machines are used for making deep pile textiles by incorporation of additional fibers in the stitches as the yarn is knitted. Prior to the formation of a stitch, each of a number of needle hooks rises into carded fiber on the surface of a respective doffer roll, engaging and drawing down a tuft of fiber which is to be incorporated into the stitch. An air jet blows over each needle as the stitch is being formed to aid in orienting the fiber taken by the needle and causing the ends of the fibers to stream toward the center of the machine.

In this process, a certain proportion of the fiber inevitably comes adrift from the surface of the doffer roll, from the needle hook, and from the stitch as it is being formed. Such stray fiber is an expensive nuisance, both in its original cost, and in the costs which are incurred in subsequently removing it from places where it is not wanted.

An exhaust system is provided, with an intake hood or bell located above the machine, and it serves to remove a considerable part of the stray fiber from the knitting area. The U.S. patent to A. J. Beucus, et al., U.S. Pat. No. 3,295,337 is illustrative of efforts which have been made to improve stray fiber control. Nevertheless, the action of the air jets directed toward the center of the machine has the result of blowing substantial amounts of stray fiber into the knitted tube as it is formed. Furthermore, the air jet associated with one stitch-forming position may disturb the air-flow patterns at one or more other stitch-forming positions in a way adversely affecting the uniformity with which fiber is held by needles in the latter positions. Most of this stray fiber become lightly frictionally engaged by the pile of the fabric, and moves down with the fabric as the knitting operation proceeds, requiring costly removal at later stages in the manufacturing process. In prior art machines, where a hole detector ring is used for a stop motion system, it has been supported from a yoke across the top of the machine, or from a spider in the bell of the exhaust hood. In either case, the support structure presents surfaces which catch and accumulate stray fiber. When bunches of fiber so collected come loose and get into the mechanism, contamination of the product and damage to the machine due to jamming may result.

SUMMARY OF THE INVENTION

To minimize the undesired accumulation of stray fiber on super structure and inside the knitted tube, the present invention provides primary air control baffle means at the knitting level, closing off substantially all the area inside the needle cylinder. The baffle has a surface so curved as to deflect the air from the air jets, after it has passed the needles, upwardly toward the exhaust hood above the machine. The control baffle is generally bell-shaped, and is mounted from below on means rotating with the needle cylinder.

Below the primary air control baffle means, a second element is mounted so that it, too, rotates with the needle cylinder. It may be bell-shaped, and extends outwardly to a diameter such as to engage the tubular fabric made by the machine. If substantially imperforate, it constitutes a secondary baffle. When provided with a substantially cylindrical depending peripheral flange, it serves as a stop motion or hole detector ring rotating with the goods.

As a secondary baffle, it helps to minimize movement of air down through the tube of knitted goods and thus further reduces any tendency of stray fiber to move from the stitch-forming area to the inside of the knitted tube.

As a rotating stop motion ring it has the advantage over stationary rings of the prior art, that it avoids skewing of the fabric tube which may result in irregularity of the edge of the goods as made by the standard tube slitter blade.

With respect both to the primary baffle, and the secondary baffle (which may also or alternatively be a stop motion detector ring), support from below eliminates the nuisance problems associated with the accumulation of stray fiber on the support structures as used in previously known machines.

BRIEF DESCRIPTION OF THE DRAWING

The invention is explained in greater detail in the following description, referring to the accompanying drawing, in which:

The single FIGURE is an elevational view, partly in section, of a circular knitting machine, illustrating the application of the invention to such a machine.

DETAILED DESCRIPTION

In the drawing a deep pile circular knitting machine is indicated generally by the reference numeral 10. The vertically reciprocating needles 12 are carried in a rotating needle cylinder 14, and operate in conjunction with other devices well known in the art to produce a tube of fabric which is indicated schematically by dotted lines 16.

During the making of each stitch, a needle rises into the card clothing of a doffer roll 18 which carries carded fiber. The needle hook draws down a tuft of fiber which is incorporated into the stitch. An air jet from a nozzle 20 blows over the needle, causing the ends of the fibers to stream toward the center of the cylinder as the tuft of fiber is being knitted into the stitch. This causes the pile of fabric to be on the inside of the tubular goods.

It will be understood that additional stitch forming points are provided around the periphery of the machine, with yarn being supplied to the needles at each point. The additional apparatus is not shown in the drawing, except for one of the nozzles 20 at the right in the figure.

The tube of knitted goods is continuously pulled downwardly by take-down rollers 22 into a tub 23; the rollers together with their supports 25 and the tub rotate with the needle cylinder and therefore with the goods. Under the tension provided by the take-down rollers, the goods are continuously cut lengthwise by a slitting blade 24. Mounted on support structure 25 or on any other appropriate member which rotates with the needle cylinder, a bracket 26 is extended through the slit in the goods, and carries a vertically extending member such as shaft 28 which likewise rotates with the needle cylinder and with the goods, thus providing a means of support believed new to the art for any device which is preferably located inside the tube of fabric and rotating with it. Fixed to this shaft and rotating with it is a primary baffle means 30 of generally conical or bell shape. Its lower edge 33 is arranged to come slightly below the jet from the nozzle 20, so that it serves to deflect upwardly toward the exhaust intake hood 31 both the air from the nozzle and the stray fiber which may be entrained with it.

The diameter and location of the lower edge 33 are such that it comes as close to the needles as practical considerations permit, so that the baffle 30 substantially seals off the upper end of the tube of fabric 16.

In machines as presently used in the art, without such a baffle, the action of jets from a number of nozzles 20 disposed around the cylinder of the machine creates a turbulent condition, which reduces the effectiveness of the exhaust hood 31 in removing stray fiber. The vortical nature of this turbulence allows a considerable amount of the loose fiber to fall into the tube of knitted goods and to be caught and retained by the pile on the inner face thereof. Furthermore, the jet from one nozzle 20 may interfere with that from another in the vicinity of their respective fiber pickup zones, which accounts for a substantial amount of fiber loss in such machines.

It will be observed in the figure, however, that nozzles 20 located on opposite sides of the machine, and essentially blowing at each other, do not have any mutual interference when the baffle 30 is used in accordance with this invention. The curved surface of the baffle is such that the respective jets of air are deflected upwardly toward the hood 31, and do not affect the action of each other in their primary function, i.e., to cause the ends of the fiber which is being incorporated into a stitch to extend toward the inside of the tube of fabric.

Below the primary baffle 30 a second member 32 is mounted on the shaft 28 and is fixed to rotate with it. It may be made substantially imperforate, in which case it serves as a secondary baffle to block movement of air downwardly in the tube of knitted goods, which might tend to carry fiber through the gap between the edge of the primary baffle and the needles. As a secondary baffle it is also preferably bell shaped. When provided with a sustantially cylindrical downwardly extending peripheral flange 34, it serves as the fabric supporting ring in a stop motion system for detection of "holes" (dropped stitches) in the goods. The flange engages and supports the goods and provides a firm backing for the action of a feeler unit or other detector device 36, the function of which is well known in the art. Such devices are shown, for example, in U.S. Pat. No. 2,862,377.

It has been customary in the past to mount a hole detector ring from above, depending from a yoke such as may be seen in U.S. Pat. Nos. 1,097,503 and 3,345,836, or from a spider located in the bell of the exhaust intake hood, with a central hub provided to mount the vertical ring support member depending therefrom. In an ordinary knitting machine such an arrangement can be quite satisfactory, because the amount of stray fiber from the yarn is not great. When used in a pile fabric knitting machine, however, where a substantial part of the sliver-fed fiber comes adrift, such structures have the severe disadvantage that their support members are an obstruction to air flow; fibers catch on them and build up into bunches which must be frequently cleaned off. A clump of such fiber, dropping onto the needles at a stitch-forming point, may be partly incorporated in the fabric, the resulting irregularity in appearance constituting an unsightly defect in the finished goods. Furthermore, it may cause malfunction of the machine, resulting in downtime and sometimes in costly damage.

With applicant's invention, whereby support is provided from below through the slit in the tubular fabric, the space above baffle 30 between the nozzles 20 and the exhaust intake hood 31 is free of supporting structure. There is nothing upon which fiber can catch and build up. Significant economies from reduction of defects and maintenance are a result with this mode of construction.

The fact that the devices mounted on shaft 28 rotate with the goods also gives rise to important advantages.

The surface of the primary baffle 30 is continually swept as it rotates in front of the nozzles 20. With a fixed baffle of similar contour, fiber in the path of the individual air jets would be dislodged, but in the relatively quiescent areas between jets, it is likely that there would still be accumulations of fiber; such a problem is avoided by the rotating primary baffle.

In the case of the member 32, the function of its downwardly extending peripheral flange 34 as a part of the stop motion system is much improved by the fact that it rotates with the goods. In prior systems, where the rotating tube of goods passes over a fixed stop motion ring, a certain amount of skewing of the goods is inevitable because of the friction of the goods against the ring, tending to twist the tube with reference to the needle level at which it is being knitted. Furthermore, the amount of skewing may be variable and erratic. An unfortunate result is that the slitting by the blade 24 is irregular, resulting in a wavy margin at the edge of the fabric when it is laid out flat. Such an edge, in effect, wastes part of the fabric area in tentering and in subsequent operations. Particularly with patterned goods, it may make pattern matching more costly for the user in terms of the yardage required.

Applicant's provision of a stop motion ring, in the form of the peripheral flange 34 on the member 32, rotating with the goods, assures that there is no tendency to twist the goods and largely eliminates the difficulties described above.

It will therefore be understood that use of the invention herein described reduces the maintenance attention which is necessary during the operation of a deep-pile knitting machine, reduces the amount of loose fiber being caught in the pile of the goods, improves the effectiveness of the exhaust hood in removal of stray fiber from the work area, and provides a straighter cut in the slitting operation.

The particular scope of the invention is defined in the following claims.

That which is claimed is:

1. In an air control system for a circular pile fabric knitting machine having a rotating needle cylinder, having air jets inwardly directed across the top of said cylinder, and having an air evacuation hood above said cylinder, the improvement comprising a separate air deflecting baffle, spaced below said hood and substantially closing the area within the needle cylinder, the space between said hood and said baffle being free from obstructions to air flow and free from fiber-catching structure.

2. A system in accordance with claim 1, wherein said baffle has a surface extending upwardly toward its center.

3. In an air control system for a circular pile fabric knitting machine having a rotating needle cylinder, having air jets inwardly directed across the top of said cylinder, and having an air evacuation hood above said cylinder, the improvement comprising a separate air deflecting baffle substantially closing the area within the needle cylinder, said baffle being supported from below.

4. In an air control system for a circular pile fabric knitting machine having a rotating needle cylinder, having air jets inwardly directed across the top of said cylinder, and having an air evacuation hood above said cylinder, the improvement comprising a separate air deflecting baffle substantially closing the area within the needle cylinder, said baffle rotating with said needle cylinder.

5. In an air control system for a circular pile fabric knitting machine having a rotating needle cylinder, having air jets inwardly directed across the top of said cylinder, and having an air evacuation hood above said cylinder, the improvement comprising a separate deflecting baffle substantially closing the area within the needle cylinder; a second baffle spaced vertically below said first mentioned baffle, and having an outer periphery of sufficient diameter to engage the tubular fabric made by said machine.

6. A system in accordance with claim 5, wherein said machine has stop motion means including a detector device located opposite the outer edge of said second baffle and cooperating with said second baffle at its outer edge.

7. A system in accordance with claim 5, wherein said second baffle rotates with said needle cylinder.

8. A system in accordance with claim 6, wherein said second baffle rotates with said needle cylinder.

9. An air control system for a circular pile fabric knitting machine having a rotating needle cylinder, having air jets inwardly directed across the top of said cylinder, and having an air evacuation hood located above said cylinder, said system including a primary baffle extending across the opening at the top of said needle cylinder, said baffle having a surface rising upwardly toward its center, and being supported from structure below it, rotating with said needle cylinder, and a secondary member spaced vertically below said primary baffle, rotating with said needle cylinder, and having an outer periphery of sufficient diameter to engage the tubular fabric made by said machine.

10. An air control system in accordance with claim 9 wherein said machine has stop motion means including a detector device located opposite the periphery of said secondary member, and cooperating therewith to sense imperfections in tubular fabric passing between said detector device and said periphery of said secondary member.

11. For use in a circular pile fabric knitting machine having a rotating needle cylinder, support means below said needle cylinder rotating therewith, a slitting blade mounted thereon, and take-down rollers arranged to pull a tube of knitted fabric past said blade so that said blade makes a continuous slit in the fabric, the improvement comprising a bracket rotating with said needle cylinder and extending through the slit in said fabric, a vertically extending member carried by said bracket, and a baffle member mounted on said vertically extending member, said baffle member extending outwardly therefrom, and rotating therewith.

12. The improvement in accordance with claim 11 wherein said baffle member extends across the opening at the top of said needle cylinder and has a surface rising upwardly toward its center.

13. The improvement in accordance with claim 11 wherein said baffle member is spaced below the top of said needle cylinder and has an outer periphery of sufficient diameter to engage the tubular fabric made by said machine.

14. The improvement in accordance with claim 11, wherein said baffle member extends across the opening at the top of said needle cylinder, and the improvement further comprises a horizontally extending member spaced below the top of said needle cylinder and having an outer periphery of sufficient diameter to engage the tubular fabric made by said machine.

15. For use in a circular pile fabric knitting machine having a rotating needle cylinder, support means below said needle cylinder and rotating therewith, a slitting blade mounted thereon, and takedown rollers arranged to pull a tube of fabric past said blade so that said blade makes a continuous slit in said fabric, the improvement comprising, in combination, a support element extending through said slit in said fabric, and a member carried on said support element within said tube of fabric substantially below the top of said cylinder, said member having a substantially-circular peripheral flange of sufficient diameter to engage the tubular fabric made by said machine.

16. The improvement in accordance with claim 15 wherein said machine has a stop-motion means including a detector device located opposite the outer surface of said circular flange and cooperating with said flange at its outer surface.

17. The improvement according to claim 14 in which said horizontally extending member rotates with said needle cylinder.

18. The improvement according to claim 15 in which said flange rotates with said needle cylinder.

* * * * *